US010336499B2

(12) United States Patent
Wambolt

(10) Patent No.: US 10,336,499 B2
(45) Date of Patent: Jul. 2, 2019

(54) DRINKING CUP

(71) Applicant: Charles Bernard Wambolt, Long Beach, MS (US)

(72) Inventor: Charles Bernard Wambolt, Long Beach, MS (US)

( * ) Notice: Subject to any disclaimer, the term of this patent is extended or adjusted under 35 U.S.C. 154(b) by 0 days.

(21) Appl. No.: 16/018,391

(22) Filed: Jun. 26, 2018

(65) Prior Publication Data

US 2019/0127106 A1 May 2, 2019

Related U.S. Application Data

(60) Provisional application No. 62/579,609, filed on Oct. 31, 2017.

(51) Int. Cl.
*B65D 3/06* (2006.01)
*A47G 19/22* (2006.01)

(52) U.S. Cl.
CPC ..... *B65D 3/06* (2013.01); *A47G 19/2205* (2013.01); *A47G 2019/2277* (2013.01)

(58) Field of Classification Search
CPC . B65D 3/06; B65D 5/08; B65D 77/12; B65D 5/3621
USPC ..... 229/400, 405
See application file for complete search history.

(56) References Cited

U.S. PATENT DOCUMENTS

| | | | | |
|---|---|---|---|---|
| 2,165,277 | A * | 7/1939 | Koch | B65D 3/06 229/405 |
| 6,102,568 | A * | 8/2000 | Davis | B65D 33/02 229/103.11 |
| 6,557,751 | B2 * | 5/2003 | Puerini | A47G 23/0216 220/738 |
| 6,616,033 | B1 * | 9/2003 | Schein | B65D 77/12 229/103.1 |
| D556,626 | S * | 12/2007 | Shaffer | D11/143 |
| D569,762 | S * | 5/2008 | Nachumzon | D11/143 |
| 9,809,373 | B2 * | 11/2017 | Gallimore | B65D 5/10 |
| 2012/0298663 | A1 * | 11/2012 | Seidel | B65D 3/08 220/212 |
| 2016/0056854 | A1 * | 2/2016 | Leung | H04B 1/3888 455/575.8 |
| 2017/0247138 | A1 * | 8/2017 | Caliri | B65D 3/12 |

* cited by examiner

*Primary Examiner* — Christopher R Demeree
(74) *Attorney, Agent, or Firm* — Payam Moradian

(57) ABSTRACT

Provided is a cup comprising a frusto-conical shaped wall that is narrower on top of the cup, the top of the cup having an opening for passage of liquid, the cup having a circular bottom made from a material that is different than material of the wall of the cup, the wall of the cup having at least two fold lines; wherein the cup has a stowed configuration where the cup is collapsed along the fold lines and the cup has a deployed configuration so that the cup can hold a liquid.

15 Claims, 2 Drawing Sheets

DRINKING CUP

CROSS-REFERENCE

The present applications claims the benefit of provisional application No. 62/579,609, filed on Oct. 31, 2017, which is incorporated herein by reference in its entirety.

BACKGROUND SECTION OF THE INVENTION

For athletes participating in distance running events, hydration during the event is mostly carried out while the athlete is still running. A water station is often established to present a plurality of filled cups so that the athletes may grab a cup of water or sports/electrolyte drink as they run past the station.

With conventional drinking cups, runners at hydration stations cannot easily drink out of traditional paper cups without spilling the liquid contents carried therein due to the large diameter of the top opening. To compensate, runners will often crush the sides of the cup together to collapse the opening in an effort to avoid spilling when the liquid contents are transferred from cup to mouth. When doing this, the runner may lose their grip on the cup and drop it. In competitive events, the runner will not want to stop or return to the hydration station. This may result in a de-hydration for the runner during the race until they reach the next hydration station.

As can be understood, there is a need for an improved drinking cup for hydration during athletic events, especially in longer events such as marathons, ultra-marathons and triathlons.

SUMMARY SECTION OF THE INVENTION

Provided is a cup that can be flattened for shipping due to the plastic material at the bottom of the cup and fold lines on the sides of the cup.

Provided is a cup comprising a frusto-conical shaped wall that is narrower on top of the cup, the top of the cup having an opening for the passage of liquid, the cup having a circular bottom made from a material that is different than material of the wall of the cup, the wall of the cup having at least two fold lines; wherein the cup has a stowed configuration where the cup is collapsed along the fold line and the cup has a deployed configuration so that the cup can hold a liquid. The height of the cup can be about 9.5 cm to about 13 cm. The bottom of the cup can be made from synthetic material and/or made up of organic polymers. The bottom of the cup can be made from polyethylene (PE), polypropylene (PP), polystyrene (PS) or polyvinyl chloride (PVC). The bottom of the cup can be made from plastic. The top of the cup can have a diameter of about 3 cm to about 4 cm. The bottom of the cup can have a diameter of about 7 cm to about 8 cm. The wall of the cup can be made from water impermeable paper. A portion of the bottom of the cup in the stowed position can be inside of the wall. The bottom of the cup can be attached to the wall of the cup with an adhesive and/or attached to the wall of the cup by heating the bottom to soften and attach to the cup through subsequent cooling. The material making the bottom of the cup can have a lower melting point at STP than material making the wall of the cup.

DETAILED DESCRIPTION OF THE INVENTION

Provided is an improved drinking cup for the hydration of athletes during athletic competitions. The drinking cup has a uniform design that conforms to the shape of the hand better, is more stable on the table, and that has a mouth sized cup lip that assures greater fluid intake with less spilling. The cup is configurable from a flattened folded/stowed (for shipping and storage) condition to an expanded condition for holding liquids.

Figure 1:
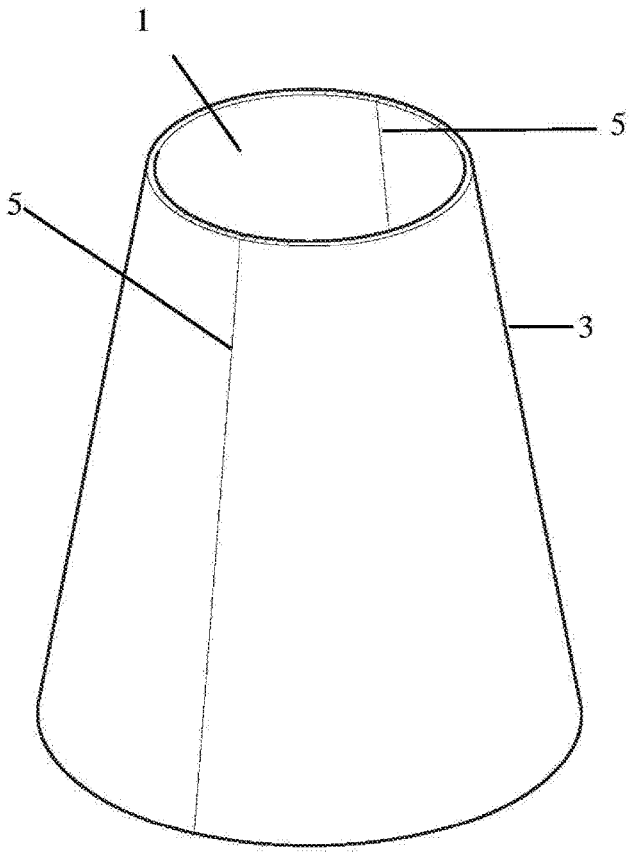
FIG. 1 illustrates a top perspective view of the cup.
Figure 2:
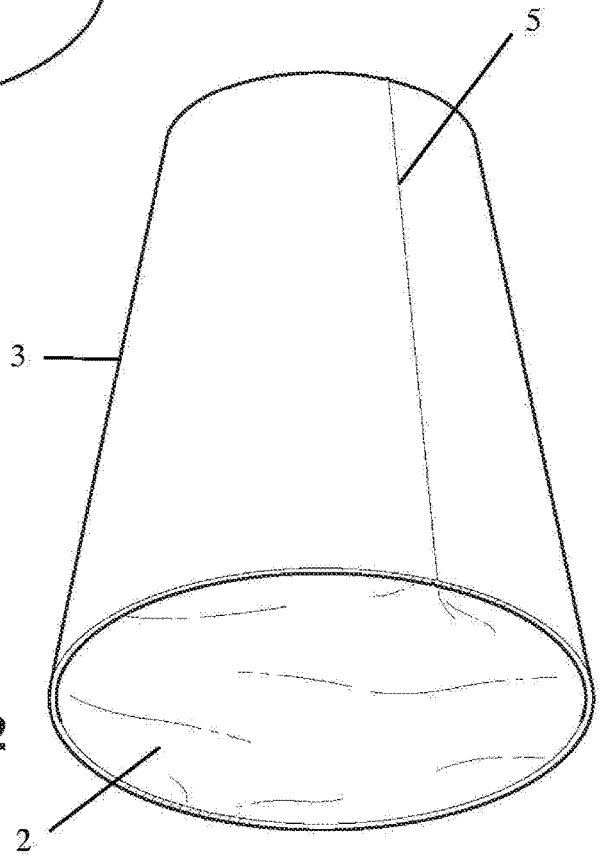
FIG. 2 illustrates a bottom perspective view of the cup.
Figure 3:
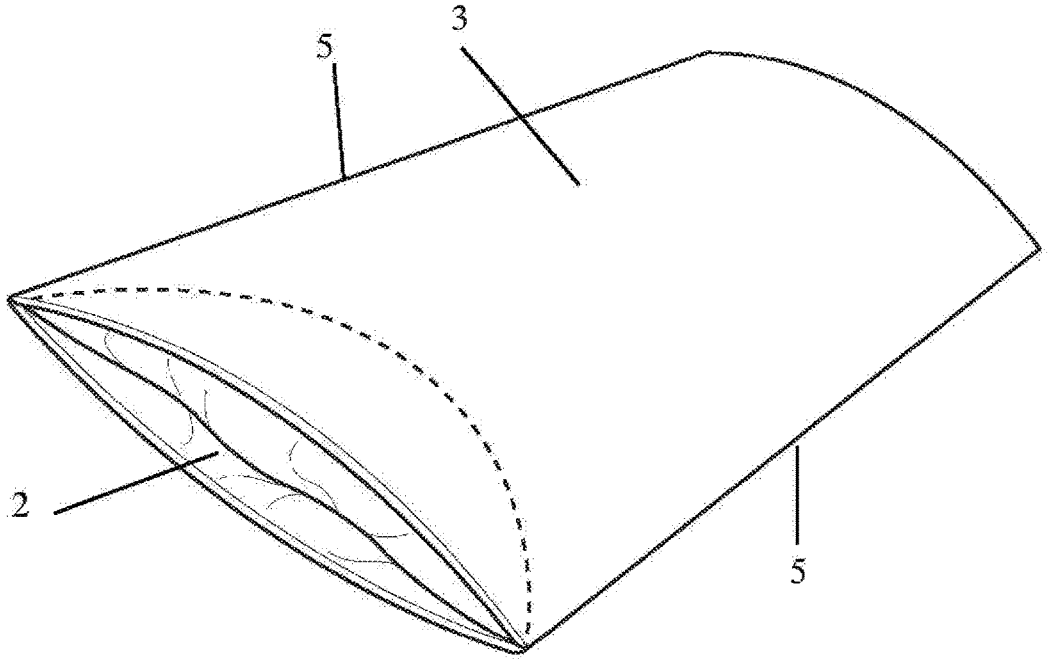
FIG. 3 illustrates the cup in a folded/stowed configuration.

As seen in reference to the drawings of FIGS. 1-3, the cup has a narrow top opening 1 and a downwardly and outwardly extending frusto-conical sidewall 3. A base 2 is sealingly joined to a bottom edge of the frusto-conical sidewall 3. The base 2 is substantially wider than that of the top opening 1. An annular lip may be formed along a top edge surface of the top opening. The base 2 may be formed of a flexible plastic material having the thickness and flexibility of a typical sandwich bag. The base 2 may be joined to the sidewall 3 by a rolling the bottom edge, and optionally with a sealant, such as wax or an adhesive. A paper rib or strap may be extended between the ends of the base 2 to provide support to the base 2 when the cup is filled with a hydration fluid. The rib may flex to permit folding of the cups to the storage condition.

At least two-fold lines 5, scores, or creases are formed along a lateral edge of the frusto-conical between the bottom edge and the top edge. The cup may be folded along the fold lines 5 to compress the cup to the flattened shipping and storage condition. When needed for use, the frusto-conical sidewall 3 may be unfolded and filled with a hydration fluid.

The narrower opening at the top 1 of the cup ensures that the runner will be able to receive a greater proportion of the hydration fluid into their mouth. The top/lip 1, being narrower than the base 2 allows for increased efficiency and effectiveness in funneling fluids into the human mouth.

The angle of the cup body reverses the currently used run cup model allowing for a more natural fit of the hand. The right circular cone design is more conducive to the normal gripping shape of the human hand. This allows for easier handling, quicker pick-ups, and less accidents/spilling.

To make this paper cup, the manufacturing shape can be a cone originating from a base of approximately 10 to 14 cm diameter (such as 12 cm) and the top/lip of approximately 3 to 5 cm (such as 4 or 3.8 cm) diameter (being the truncated superior portion of the cone), and an approximate height of 7 cm to 12 cm (such as 10 cm) in 3-dimensional earth space. The cup may be packaged normally and marketed to any entity desiring its use; primarily in races, but also in community runs or any other venue needing better cup stability. The product can be unpackaged normally, set up at races (or other venues), filled with water &/or other fluids for human consumption, and picked up by runners at designated tables.

When large numbers of cups are placed on tables from small to mega-sized races, multitudes of cups can be blown over in strong wind or heavy bumps of tables. With traditional cups, toppling of the cups occur more easily because traditional cups are heavier at the top than at the bottom (due to the small base/large top design). The base in the newly designed cup, being wider at the bottom than at the top, causes the weight of the cup to be distributed toward the bottom, allowing greater stability than standard cups used today.

The base-to-lip/wider-to-narrower aspect ratio of the cup provides a more stable platform. A hydration station can fill multiple cups in and set them on the table with a lower likelihood of toppling in strong wind conditions, bumping of the table or other service platform, or being bumped by one of run participants as they grab a cup on the run.

When a person's second digit/phalange/pointing finger is brought to their thumb (tip to tip) forming a circle (A-OK sign), it is much more natural/relaxed than using the 5th digit/phalange/pinky finger to create a small circle, i.e., the hand more normally fits a cup with this invention design rather than a traditional cup.

The angle of the cup body reverses the currently used raining cup model allowing for a more natural fit of the hand. The right circular cone design is more conducive to the normal gripping shape of the human hand. This allows for easier handling, quicker pick-ups, and less accidents/spilling. The largest and most significant problem to currently used run cup models is the large mouthed exit for the water or other fluid. This causes runners to have to slow down significantly to swallow fluids without spilling them; otherwise a fast transition almost always causes fluids to be spilled/wasted. Fluid is also wasted/lost upon the grabbing of cups by runners because the top/lip/exiting portion of the traditional cups offers greater ease of escaping from the cup. This problem is exacerbated by the fact that many runners lose smooth coordination ability as they become winded, exhausted/fatigued, and blood supply is shunted to the legs causing less blood for the brain to coordinate other movements smoothly.

The top/lip of the cup, being narrower than the base, improves the efficiency and effectiveness in funneling fluids into the human mouth. This results from the drinking site of the cup being significantly smaller, allowing fluid to flow into the mouth rather than spilling, in and around it during fast moving transitions. The stability drinking cup can be used by any group desiring the benefits it offers.

REFERENCES

1. Opening on top
2. Base
3. Sidewall
5. Fold Lines

What is claimed is:

1. A cup comprising a frusto-conical shaped wall that is narrower on top of the cup, the top of the cup having an opening for passage of liquid, the cup having a circular bottom made from plastic and a wall made from paper, the wall of the cup having at least two fold lines; wherein the cup has a stowed configuration where the cup is collapsed along the fold lines and the cup has a deployed configuration so that the cup can hold a liquid, wherein a portion of the bottom of the cup in the stowed position can be inside of the wall.

2. The cup of claim 1, wherein height of the cup is about 9.5 cm to about 13 cm.

3. The cup of claim 1, wherein height of the cup is about 9.5 cm to about 11 cm.

4. The cup of claim 1, wherein the bottom of the cup is made from a synthetic material made up of organic polymers.

5. The cup of claim 1, wherein the bottom of the cup is made from polyethylene (PE), polypropylene (PP), polystyrene (PS) or polyvinyl chloride (PVC).

6. The cup of claim 1, wherein top of the cup has a diameter of about 3 cm to about 4 cm.

7. The cup of claim 1, wherein top of the cup has a diameter of about 3.5 cm to about 4 cm.

8. The cup of claim 1, wherein bottom of the cup has a diameter of about 7 cm to about 8 cm.

9. The cup of claim 1, wherein bottom of the cup has a diameter of about 7.3 cm to about 7.8 cm.

10. The cup of claim 1, wherein the wall of the cup is made from paper.

11. The cup of claim 1, wherein the wall of the cup is made from paraffin or wax paper.

12. The cup of claim 1, wherein the wall of the cup is made from water impermeable paper.

13. The cup of claim 1, wherein the bottom of the cup is attached to the wall of the cup with an adhesive.

14. The cup of claim 1, wherein the bottom of the cup is attached to the wall of the cup by heating the bottom to soften and attach to the cup through subsequent cooling.

15. The cup of claim 1, wherein material making the bottom of the cup has a lower melting point at STP than material making the wall of the cup.

* * * * *